United States Patent [19]

Comeau

[11] 4,274,467

[45] Jun. 23, 1981

[54] DRAPERY AND SUPPORT COMBINATION

[75] Inventor: Paul E. Comeau, Warwick, R.I.

[73] Assignee: Kenney Manufacturing Company, Warwick, R.I.

[21] Appl. No.: 27,466

[22] Filed: Apr. 5, 1979

Related U.S. Application Data

[63] Continuation-in-part of Ser. No. 23,071, Mar. 23, 1979, Pat. No. 4,254,815.

[51] Int. Cl.[3] ..... E06B 3/48; E05D 15/26; A47H 5/00

[52] U.S. Cl. ..... 160/84 R; 160/183; 160/199; 160/345

[58] Field of Search ..... 160/84 R, 84 V, 84 H, 160/124, 126, 183, 199, 206, 345, 346

[56] References Cited

U.S. PATENT DOCUMENTS

| | | | |
|---|---|---|---|
| 2,703,140 | 3/1955 | Bonawit | 160/199 |
| 2,802,522 | 8/1957 | Collet | 160/84 R |
| 2,806,525 | 9/1957 | Stankewich et al. | 160/84 R |
| 3,131,753 | 5/1964 | Dixon | 160/183 |
| 3,616,486 | 11/1971 | Ford et al. | 160/345 |
| 3,818,543 | 6/1974 | Baker, Sr. | 160/345 |

*Primary Examiner*—Philip C. Kannan

[57] ABSTRACT

A drapery and support combination is provided for a slat type ("woven wood") curtain wherein spacers between the slats are connected to the support elements in such a way that, in the fully closed position of the curtain, the spacers hold the slats at the correct angle independently of the looseness of the curtain material which hinges the slats to each other. The spacers are flat and arranged in a vertical plane so as to present an attractive appearance and not to interfere with opening or closing the curtain. The end slats are adapted to pivot on a fixed axis which may be either on the centerline of the slat, or, on the outer margin of the end slat in which latter case, the end slat is supported at a second point which slides relative to the curtain rod along an arcuate path the center of which is on the pivot axis of the end slat. One or more additional slats may be added to the fixed outer margin in order to extend the curtain coverage back to a wall.

8 Claims, 12 Drawing Figures

FIG. 4
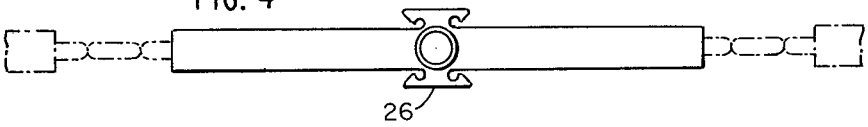
FIG. 6
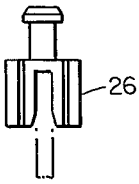
FIG. 5
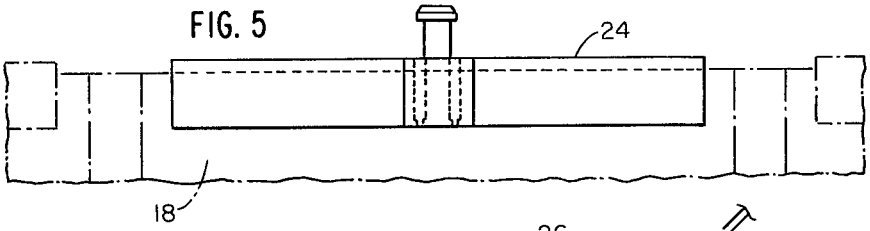
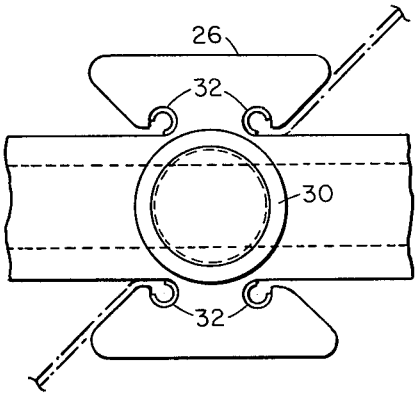
FIG. 7
FIG. 9
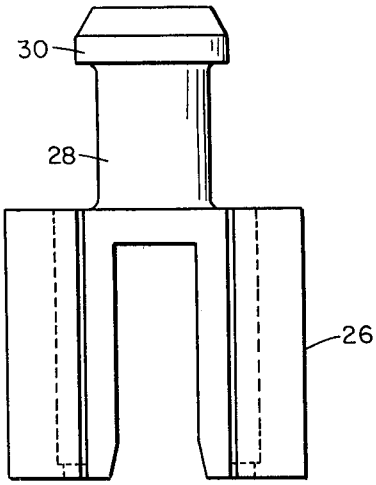
FIG. 8
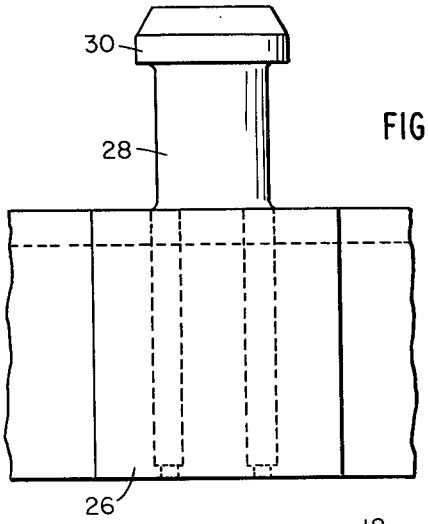
FIG. 10
FIG. 11
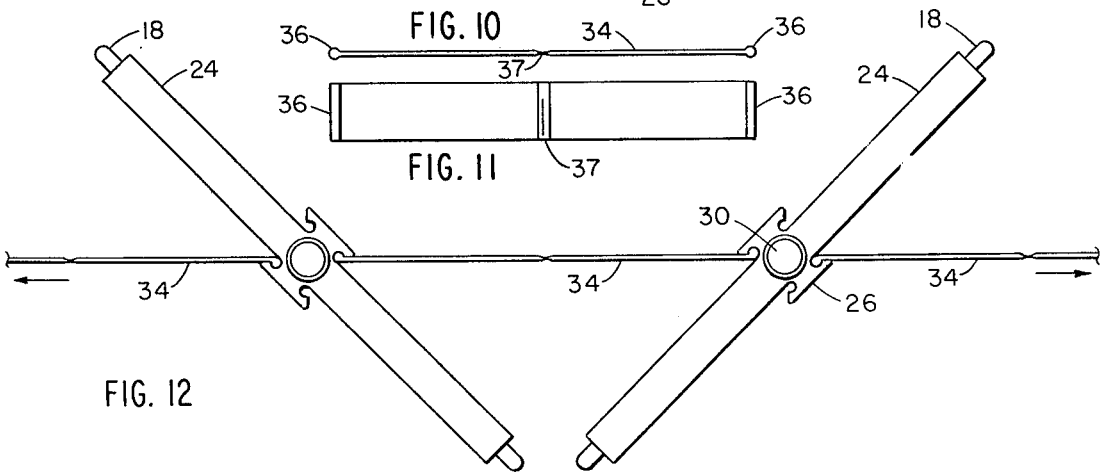
FIG. 12

DRAPERY AND SUPPORT COMBINATION

FIELD OF THE INVENTION

The present invention is a continuation-in-part of application Ser. No. 23,071, filed Mar. 23, 1979, now U.S. Pat. No. 4,254,815, entitled "Curtain Supporting and Positioning Combination".

The invention relates to draperies and supports therefor. More particularly, the invention relates to slat-type curtains sometimes referred to as "woven wood", and to supporting devices designed to meet special needs of such curtains.

BACKGROUND OF THE INVENTION

"Woven wood" is a term used to describe certain drapery material comprising slats of wood, plastic or the like joined by fabric or other flexible material. In a typical installation the slats are arranged horizontally and the curtain is rolled up and down on cords. It has been suggested to arrange the slats vertically and suspend them from above on a traverse rod arranged with carriers and a pull cord to open and close the curtain, in accordion fashion, but such a suggestion has only rarely been followed even in the custom designed curtain trade. One of the problems associated with the vertically disposed arrangement has to do with keeping the slats properly spaced and aligned. The human eye is not good for estimating the value of dimensions of items standing alone but the eye readily detects proportions between items and dimensional differences between related objects, with extreme accuracy. Thus, slight misalignments and variations in the slat spacing in a vertically disposed woven wood curtain are noticeable and bothersome. One way to support and align woven wood curtains employed in the past included the use of horizontal strips of plastic or cord secured to the top of each slat to limit the distance therebetween when the curtain was closed (slats fully extended) to a specific dimension. This was intended to place the slats in perfect alignment, but in practice, due to looseness of the fabric hinges between the slats, the slats would assume positions of minor misalignment which the eye could detect. In addition, when the curtain was opened up so as to bunch the slats at the sides, the spacing cords or horizontal strips at the tops of each slat would also bunch up, and extend either upwardly where they would interfere with the sliding action of the curtain carrier, or they would extend downwardly in the form of unsightly loops where they would also interfere with the bunching of the slats.

Another problem associated with vertically disposed slat-type curtains had to do with the manner in which the ends of the curtain were supported. Thus, if the end slat was pivoted about a fixed vertical axis, along its centerline, when the curtain was closed, one half of the end slat pivoted away from the wall and opened up a slit for the passage of light. On the other hand, if the end slat was fixed to the wall, it could not pivot in the same way as the intermediate slats. Hitherto there has been no solution for this problem, and non-uniformity along the side margins of such curtains has remained a problem.

Accordingly, among the objects of the invention is the provision of a vertically arranged slat-type curtain and support combination in which the vertical alignment and spacing between slats is accurately controlled. A further object is to provide accurate spacing means which neither interferes with the sliding action of the curtain supports nor hangs down to present unsightly loops or an obstacle to bunching. Still another object is to provide means for supporting the curtain ends so as to avoid opening up a light leak along the sides of the curtain when it is closed and to permit the use of additional curtain material between the marginal end of the curtain and a wall if desired.

BRIEF DESCRIPTION OF THE INVENTION

The present invention comprises in combination a curtain rod mounted on a wall adjacent to an opening such as a window or the like which requires a curtain. The curtain comprise a plurality of slats joined along their lateral edges in the manner of "woven wood" to form a curtain which opens and closes in accordion fashion. The slats comprise an end slat at each side of the curtain and intermediate slats in between. The upper ends of the intermediate slats are suspended from idler carriers which slide or roll in the curtain rod, and the intermediate slats pivot in the idler carriers on axes passing through their centerlines. The end slats pivot on fixed axes either on their center lines or on their outer marginal edges. In the latter case the end slats are supported at a second point to slide relative to the curtain rod on an arc the center of which is on the pivot axis of the end slat. Additional curtain material may be added to extend the curtain back to the wall.

Accurate spacing and angular disposition of the slats is attained by the use of spacers together with means for connecting them to central base members of the slat supports in such a way as to pull the slats to the correct angle independently of looseness of the fabric hinge material between the slats. The spacers comprise short, flat, flexible strips, arranged parallel to the axis of the curtain rod in the vertical plane thereof. An added feature of the spacers is that, when the curtain is closed, they appear as a straight line parallel to and on the same plane as the curtain rod, and, when the curtain is opened, they fold together without bending upwardly or downwardly and thereby they avoid either interference with the action of the idler carriers or unsightly downwardly extending loops.

BRIEF DESCRIPTION OF THE DRAWINGS

The embodiment of the present invention selected for purposes of illustration is shown in the accompanying drawings in which:

FIG. 4 is a plan view of a slat supporting member which is attached to the top of each slat (shown in dotted lines in the figure);

FIG. 5 is a view in side elevation of the slat supporting member of FIG. 4;

FIG. 6 is a view in end elevation of the slat supporting member of FIGS. 4 and 5;

FIG. 7 is an enlarged plan view of the central base member of the slat supporting member of FIGS. 4–6;

FIG. 8 is an elongated view in side elevation of the central base member of FIG. 7;

FIG. 9 is an enlarged view in end elevation of the central base member of FIGS. 7 and 8;

FIG. 10 is a plan view of a spacer employed to limit the angle between slats when the curtain is in the closed position;

FIG. 11 is a view in side elevation of the spacer of FIG. 10, and

FIG. 12 is a plan view of a pair of slat supporting members in position with the curtain in the fully closed position and the spacers under tension and fully extended.

DETAILED DESCRIPTION OF THE ILLUSTRATIVE EMBODIMENT

Figure 1:
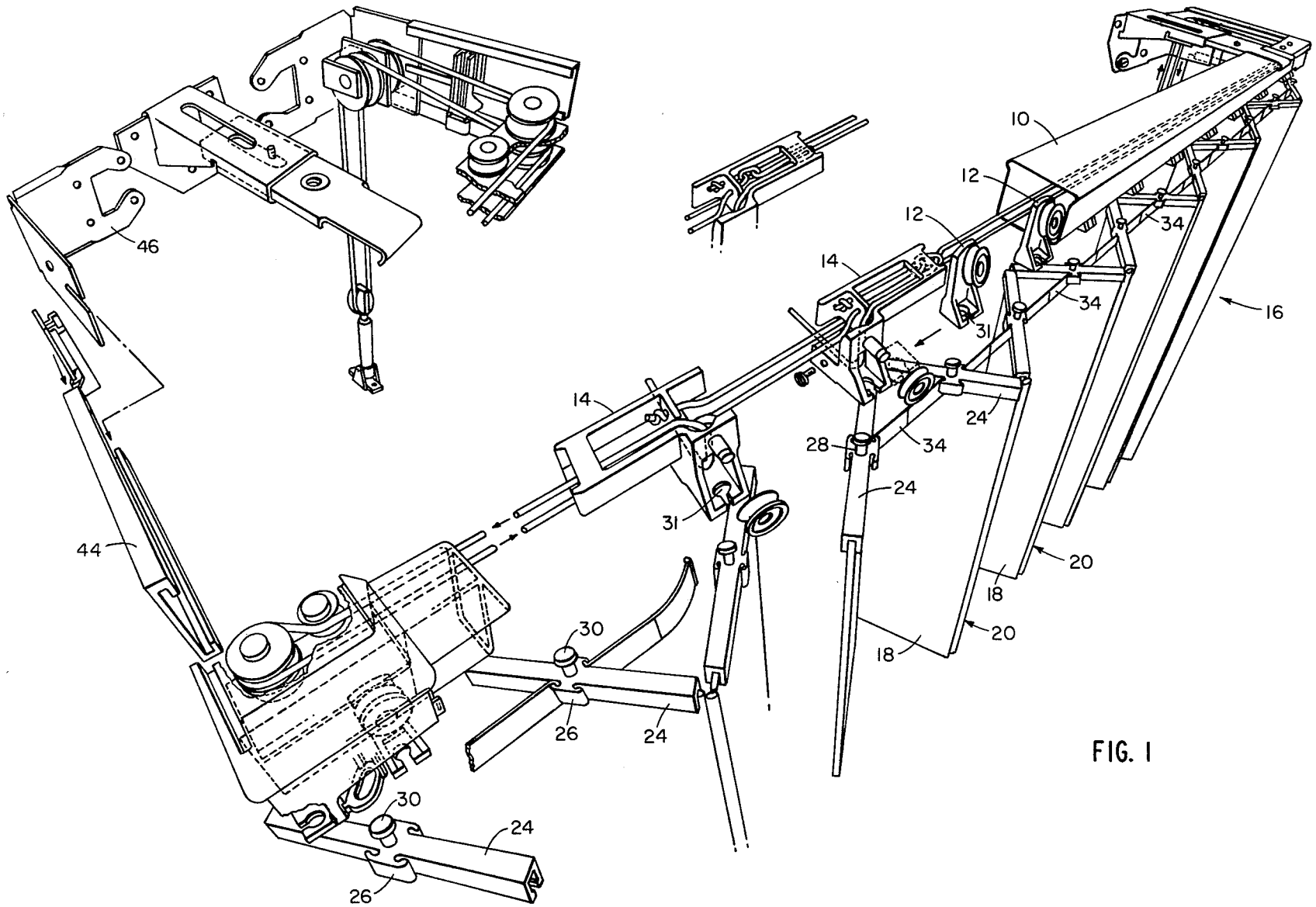
FIG. 1 is an expanded perspective view showing a slat type curtain and support combination employing the invention.

The embodiment of the invention selected herein for illustration comprises a curtain rod 10 adapted with idler carriers 12 and master carriers 14 to support a curtain indicated generally at 16. The curtain 16 comprises a plurality of elongated vertically intermediate slats 18 and end slats 22 (see FIG. 3) hinged loosely by fabric (and/or additional material) at 20, and arranged to move between opened and closed positions in accordion fashion. The end slats 22 (see FIG. 3) remain at the ends of the rod and the intermediate slats divide in the middle and are pulled to the sides by cords operating on the master carriers by mechanisms not described herein in detail because they form no part of the present invention.

The intermediate and end slats, 18 and 20, are each provided with integrally molded plastic slat supporting members 24 secured to the upper ends of the slats 18 and 20. Slat supporting members 24 also include central base members 26 which are provided with a slat supporting, upstanding pivot pin 28 having an enlarged head 30. Idler and master carriers 12 and 14 respectively are provided with keyhole slots 31 adapted to receive pins 28 and pivotally support same thereon by means for said enlarged heads 30.

Central base members 26 are also provided with slots 32 having a reduced diameter at their lower ends orthogonally arranged about the axis of pins 28 and at 45° angle from the longitudinal axis of supporting members 24. Spacer strips 34 having enlarged ends 36 are employed to limit the maximum space between slats when the curtain is fully closed. This is done by lodging the enlarged ends 36 of spacers 34 in one pair of diametrically aligned slots 32 of successive slat supporting members 24. The reduced diameter at the lower ends of slots 32 keep the spacers 34 from falling out. In FIG. 12 such an arrangement is shown wherein it will be seen that, when the curtain is fully closed and spacers 34 are fully extended and under tension, they pull slat supporting members 24 to a fixed angle of 45° from the plane of the curtain rod independently of the looseness of the fabric or other material of the hinges 20. In fact the slats will assume this angle with nothing joining the slat edges. An advantage of the orthogonal arrangement of four slots 32 in this matter is that a single molding for slat supporting members 24 may be employed for both right and left hand slats.

While an angle of 45° has been illustrated, it will be understood that any preselected angle permitted by the thickness of the slats may be employed, with the location of slots 32 relative to the longitudinal axis of slat supporting members 24 changed accordingly.

Since when the curtain is closed (see FIG. 1), the spacers 34 are fully extended and in a vertical plane which is, in fact, the vertical plane of the longitudinal axis of the curtain spacers 34 have the appearance of a straight, flat, elongated member at the top of the curtain associated with the rod. When the curtain is drawn to the opened position, spacers 34 bent but remain in the same horizontal plane and therefore they neither interfere with the action of the idler or master carriers nor project visibly to present unsightly loops below the top level of the curtain. Spacers 34 are provided with a central line of reduced thickness 37 to promote the bending action of spacers 34 during the curtain opening operation.

Figure 2:
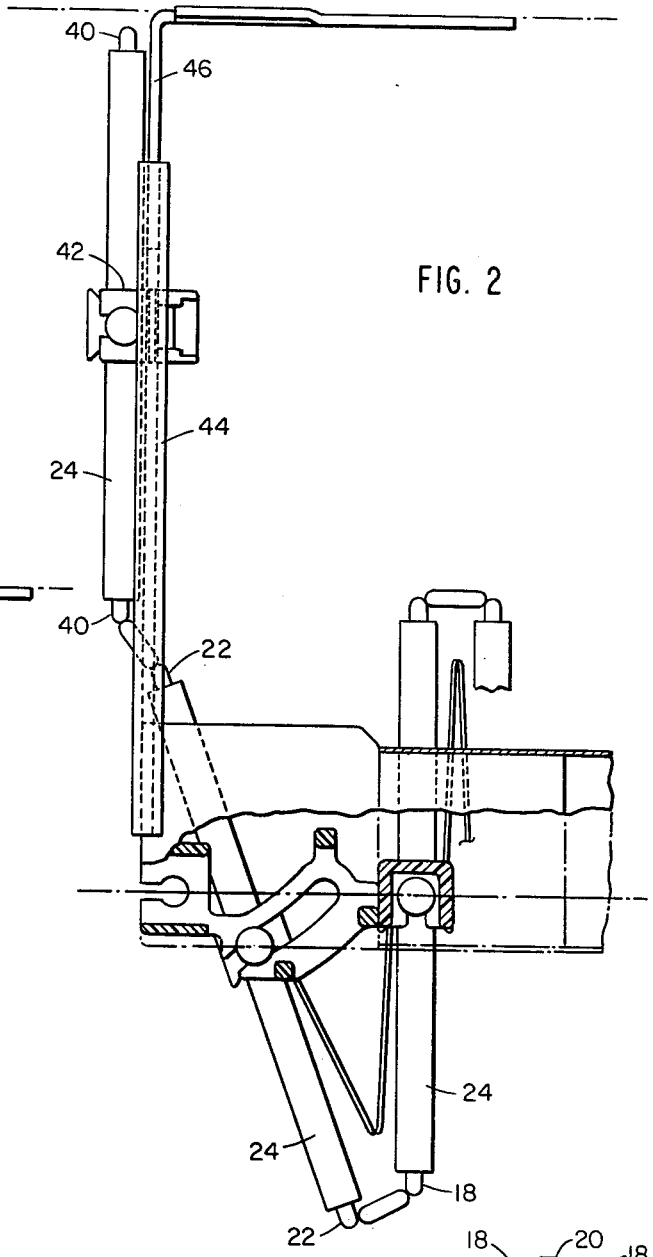
FIG. 2 is a plan view of the supporting arrangement for the end of the curtain, partly broken away to show the pivoting action when an end slat of the curtain is anchored at its outer margin, with the curtain in its fully opened position.
Figure 3:
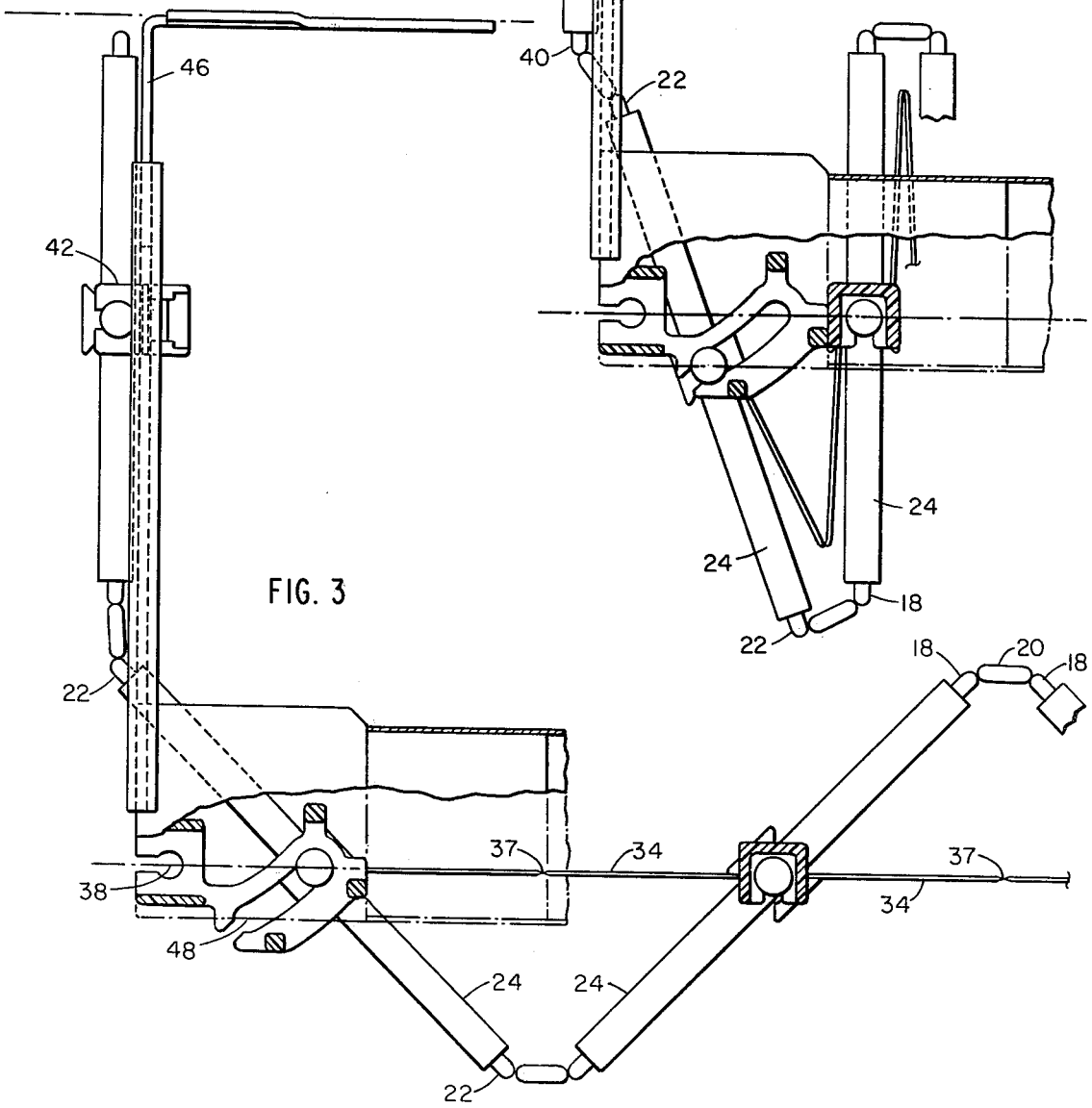
FIG. 3 is a plan view of the same components as FIG. 2 except that it shows the curtain in the fully closed position.

The end slats 22 may be mounted to pivot about their central axes in a fixed keyhole slot 38 (see FIG. 3) at each end of the rod (one only shown). When the end slats 22 are so mounted, the curtain end pivots away from the wall, and as a result, a light gap may open up along the edge of the curtain. This can be overcome either by securing a section of loose flexible material across the gap between the curtain end and the wall, or by extending the slat-type ("woven wood") curtain material back to the wall. In the latter case, due to the lateral stiffness of the material, provisions must be made at the upper ends of end slats 22 to allow for lateral motion. One way of accomplishing this is shown in FIGS. 2 and 3, wherein a fixed slat 40 is mounted adjacent to the wall and is suspended from above by a fixed carrier 42, mounted on an arm 44 which is in turn mounted on the wall by bracket 46. Fixed slat 40 is hinged to end slat 22, and thereby effectively pivots end slat 22 about an axis defined by the hinge 20 between fixed slat 40 and end slat 22. When end slat 22 pivots on such an axis, however, in response to the closing or opening action of the curtain, its center axis and hence the pin 28 must move along an arcuate path the center of which is the pivot axis defined by the hinge between end slat 22 and fixed slat 40. Such motion is permitted by means of an acruate slot 48 adjacent to the end of rod 10 at the level of the keyhole slots 31 and 38. In FIG. 2 one end of the curtain is shown in the fully opened position in which intermediate slats 18 are bunched together in parallel relation. It will be understood that the other end is the same in reverse. In the position of FIG. 2, end slats 22 at each end of the rod do not assume the same angle as intermediate slats 18, but instead, both end slats assume an acute angle of about 25°. Since, both angles, however, are the same, the end slats present a symmetrical appearance of extra thickness on each side of the curtain which frames the curtain and is generally pleasing to the eye.

Various modifications of the invention will now be obvious to those skilled in the art. For example, the angle between the intermediate slats 18 may be varied along the rod to provide a gradation of angles if desired. Different types of slat and hinge material may be used, and the hinge material may even be omitted entirely except when the embodiment of FIGS. 2 and 3 is employed. Accordingly, it is not intended to confine the invention to the precise form herein shown but rather to limit it only in terms of the appended claims.

I claim:

1. A drapery and support combination comprising:

(a) a horizontally disposed curtain rod mounted on a base;

(b) a curtain made up of a plurality of elongated slats arranged to form a curtain which moves between opened and closed positions in accordion fashion;

(c) slat supporting means at the upper end of each slat for suspending same in sliding and pivoting relation from said rod;

(d) means associated with said slat supporting means for holding the angle between adjacent slats, when said curtain is in the closed position, at a predetermined angle relative to the axis of said rod, independently of the means for joining the lateral edges of the slats; and the slat supporting means having a central support member and a pair of slots therein positioned relative to the pivot axis of said slat such that tension applied to said central support member along a line parallel to and in a common vertical plane with the axis of said curtain, pivots said slat to said predetermined angle.

2. The drapery support combination defined in claim 1 further characterized by:

said means for holding the slats at the predetermined angle comprising a flat, flexible spacer strip connected between each slat supporting means in a vertical plane which includes the longitudinal axis of said rod.

3. The drapery and support combination defined in claim 2 further characterized by:

a pair of slots in each slat supporting means disposed on opposite sides of the pivot axis thereof at said predetermined angle, and said strips connected to said slat supporting means in said slots.

4. The drapery and support combination defined in claim 3 further characterized by:

each said strip having an enlarged head and such said slot having an enlarged recess for receiving one said head.

5. A drapery and support combination comprising:

(a) a horizontally disposed curtain rod mounted on a base;

(b) a curtain made up of a plurality of elongated slats arranged to form a curtain which moves between opened and closed positions in accordion fashion;

(c) slat supporting means at the upper end of each slat for suspending same in sliding and pivoting relation from said rod;

(d) means associated with said slat supporting means for holding the angle between adjacent slats, when said curtain is in the closed position, at a predetermined angle relative to the axis of said rod, independently of the means for joining the lateral edges of the slats;

(e) means for supporting an end slat of said curtain to pivot about an axis which is fixed relative to said rod, the fixed pivot axis of said end slat being at the outer marginal end of said end slat, and (f) means supporting said end slat on said rod including an elongated slot which follows an arc the center of which is at the pivot axis of said end slat.

6. The drapery and support combination defined in claim 5 further characterized by:

at least one additional slat connected to said curtain along the outer margin of said end slat.

7. A drapery and support combination comprising:

(a) a horizontally disposed curtain rod mounted on a base;

(b) a curtain made up of a plurality of elongated slats and means for joining the slats at their lateral edges to form a curtain which moves between opened and closed positions in accordion fashion, said curtain comprising a slat at each end and intermediate slats;

(c) means for supporting said intermediate slats in sliding and pivoting relation on said rod;

(d) means for supporting at least one said end slat to pivot about a fixed axis which coincides with its outside lateral margin, and (e) means for supporting said end slat at a second point in sliding relation to said rod in an acruate path the center of which is on the pivot axis of said end slat.

8. The drapery and support combination defined in claim 7 further characterized by:

at least one additional slat connected to said curtain along the outer margin of said end slat.

* * * * *